US010084228B2

(12) United States Patent
Chiu et al.

(10) Patent No.: US 10,084,228 B2
(45) Date of Patent: Sep. 25, 2018

(54) SYSTEM OF INTEGRATED MODULE WITH ANTENNA

(71) Applicant: HONGBO WIRELESS COMMUNICATION TECHNOLOGY CO., LTD., Taipei (TW)

(72) Inventors: Tsung-Wen Chiu, Taipei (TW); Yao-Yuan Chang, Taipei (TW); Yu-Lin Shih, Taipei (TW); Chia-Hsien Wei, Taipei (TW); Kuan-Wei Lee, Taipei (TW)

(73) Assignee: HONGBO WIRELESS COMMUNICATION TECHNOLOGY CO., LTD., Taipei (TW)

( * ) Notice: Subject to any disclaimer, the term of this patent is extended or adjusted under 35 U.S.C. 154(b) by 99 days.

(21) Appl. No.: 15/334,275

(22) Filed: Oct. 25, 2016

(65) Prior Publication Data

US 2017/0222299 A1 Aug. 3, 2017

(30) Foreign Application Priority Data

Jan. 29, 2016 (TW) ..... 105102841 A

(51) Int. Cl.

| | |
|---|---|
| ***H01Q 1/24*** | (2006.01) |
| ***H01Q 1/22*** | (2006.01) |
| ***H01Q 1/38*** | (2006.01) |
| ***H01Q 1/48*** | (2006.01) |
| ***H01Q 13/10*** | (2006.01) |
| ***H01Q 9/04*** | (2006.01) |

(52) U.S. Cl.

CPC ..... *H01Q 1/2266* (2013.01); *H01Q 1/24* (2013.01); *H01Q 1/38* (2013.01); *H01Q 1/48* (2013.01); *H01Q 9/0421* (2013.01); *H01Q 13/10* (2013.01)

(58) Field of Classification Search

CPC ..... H01Q 1/24; H01Q 1/2266
USPC ..... 343/702
See application file for complete search history.

(56) References Cited

U.S. PATENT DOCUMENTS 9,853,348 B2 * 12/2017 Lee ..... H01Q 1/243
2008/0079639 A1 4/2008 Jen-Huan
(Continued)

FOREIGN PATENT DOCUMENTS

TW 201448349 A 12/2014

*Primary Examiner* — Dameon E Levi
*Assistant Examiner* — Hasan Islam
(74) *Attorney, Agent, or Firm* — Maschoff Brennan

(57) ABSTRACT

A system of integrated module with antenna used for an electronic device comprises a circuit board, at least one antenna exciting unit, a wireless module, a module grounding plane, a grounding metal, a camera module and a digital signal line. The antenna exciting unit is used to couple with an antenna. The wireless module and the camera module are disposed on the circuit board to couple with the module grounding plane. The wireless module is electrically connected to the antenna exciting unit. The grounding metal is electrically connected to the module grounding plane and a system grounding plane. The digital signal line is electrically connected to the wireless module and the camera module is a digital transmission media. The wireless module, the camera module and the circuit board constitute an integrated module for disposing at an up-side of a screen of the electronic device.

7 Claims, 8 Drawing Sheets

(56) References Cited

U.S. PATENT DOCUMENTS

2013/0207853 A1* 8/2013 Yamamoto ..... H01Q 1/002
343/702
2014/0078008 A1* 3/2014 Kang ..... H01Q 5/35
343/702

* cited by examiner

SYSTEM OF INTEGRATED MODULE WITH ANTENNA

CROSS-REFERENCE TO RELATED APPLICATIONS

This non-provisional application claims priority under 35 U.S.C. § 119(a) on Patent Application No(s). 105102841 filed in Taiwan on Jan. 29, 2016, the entire contents of which are hereby incorporated by reference.

BACKGROUND

Technical Field

The disclosure relates to an integrated module, and more particularly to a system of integrated module capable of integrating the camera module.

Related Art

Please refer to FIG. 1 through FIG. 4. Conventionally, the embedded antenna designs for electronic device such as laptop may be categorized into the following types according to the location for disposing the antenna. In the design of FIG. 1, one or more antennas 2*a* and 2*b* are disposed at the upper edge of the screen of the laptop so as to achieve a good radiation pattern with less interference of noise for the simple surrounding of the antenna. Here, the antenna 2*a* and the antenna 2*b* are connected to the wireless module 1 via the co-axial cable 3*a* and co-axial cable 3*b*, respectively. However, the attenuation of the design may be severe because the length of each of the co-axial cables 3*a* and 3*b*. Further, the way of assembling the wires from the co-axial cable 3*a* and the co-axial cable 3*b* to the wireless module 1 is complicated. The embedded antenna design for television or integrated computer encounters similar obstacle.

In the design in FIG. 2, antenna 2*a* and antenna 2*b* are disposed around the hinge under the screen. Compared with FIG. 1, the way for disposing the antenna in FIG. 2 may reduce the length of each of the co-axial cable 3*a* and 3*b* so as to reduce the loss of the radiofrequency signal and leave more space for the graph or symbol of the brand. However, the installation of the antenna in FIG. 2 results in bad radiation pattern and the antenna suffers from the interference. Further, the specific absorption rate (SAR) according to safety specifications is also a problem to be considered.

Then, according to the design in FIG. 3, the antennas 2*a* and 2*b* are disposed on the two lateral surface of the keyboard, so it suffers from more interference compared with the aforementioned designs and its efficiency of the antenna is worse. Further, the SAR according to the safety specifications needs to be further considered. Then, please refer to the design in FIG. 4, the antennas 2*a* and 2*b* are integrated with the wireless module 1 and installed in the hinge of the laptop, and the wireless module 1 is connected to the system via the digital signal line 3*c*. Further, the camera module 4 disposed in center of the upper edge of the screen is connected to the system via the digital signal line 5. The installation makes the antenna suffer from more noise interference and have worse efficiency compared with the aforementioned designs. The SAR problem according to the safety specifications still needs to be considered. Although the antennas 2*a* and 2*b* are integrated with the wireless module 1 so there is no need for co-axial cable and the loss of the radiofrequency signal is reduced, it is still needed to connect the camera module 4 to the system via the digital signal line 5. The camera module 4 and the wireless module 1 are separated from each other and the digital signal lines they used are separated from each other as well.

SUMMARY

The embodiment of the disclosure provides a system of integrated modules for being installed in an electronic device. The system of integrated module includes a circuit board, at least one antenna exciting unit, a wireless module, a module grounding plane, a system grounding plane, a grounding metal, a camera module, and a digital signal line. The at least one antenna exciting unit is used for coupling with an antenna. The wireless module is electrically connected to the module grounding plane and the antenna exciting unit, and they are both disposed on the circuit board. The radiofrequency signal of the wireless module is coupled to the radiator of antenna via the antenna exciting unit. The grounding metal is electrically connected to the module grounding plane and the system grounding plane. The camera module is disposed on the circuit board and is electrically connected to the module grounding plane. The digital signal line is electrically connected to wireless module and the camera module to act as the digital communication interface between the wireless module and the camera module. An integrated module is composed of the wireless module, the camera module, and the circuit board. The integrated module is disposed adjacent to an upper edge of a screen of the electronic device.

BRIEF DESCRIPTION OF THE DRAWINGS

The present disclosure will become more fully understood from the detailed description given hereinbelow and the accompanying drawings which are given by way of illustration only and thus are not limitative of the present disclosure and wherein.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1:
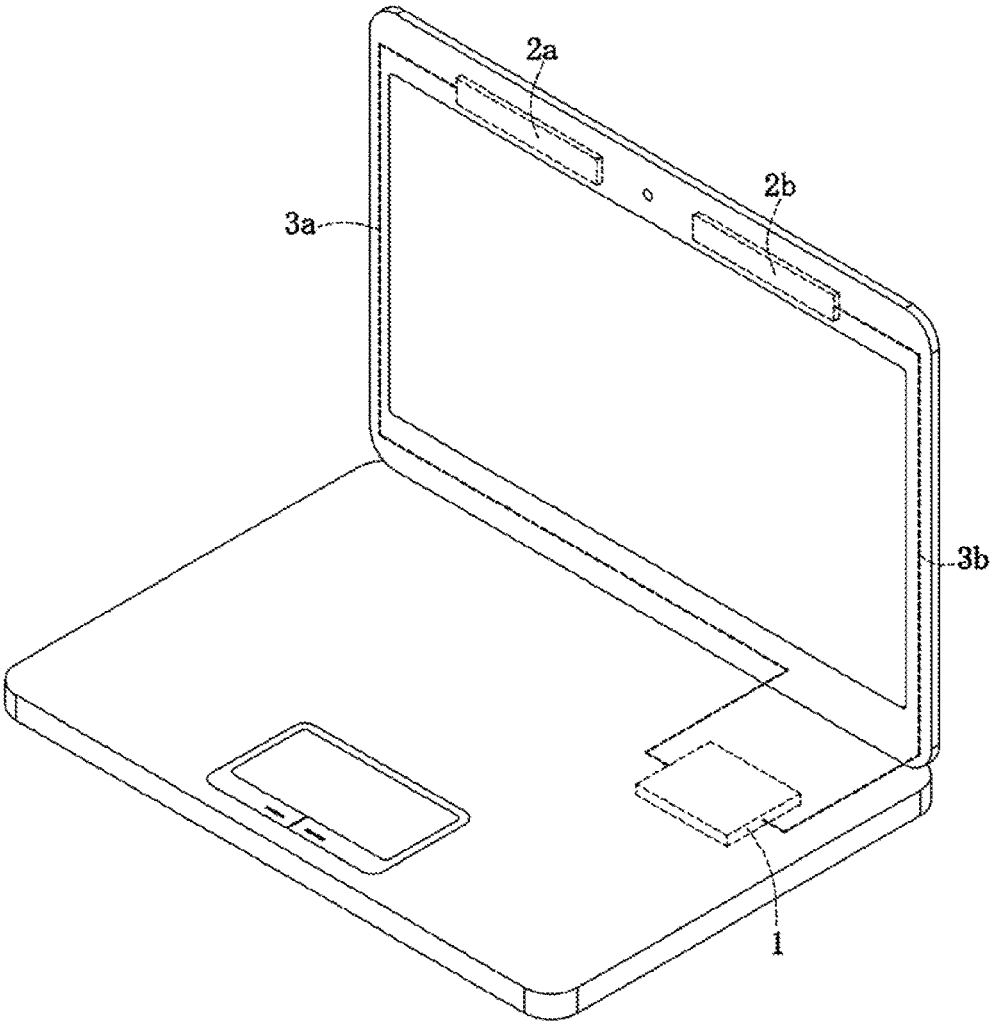
FIG. 1 (PRIOR ART)
FIG. 1 is a schematic of a conventional embedded antenna for laptop.
Figure 2:
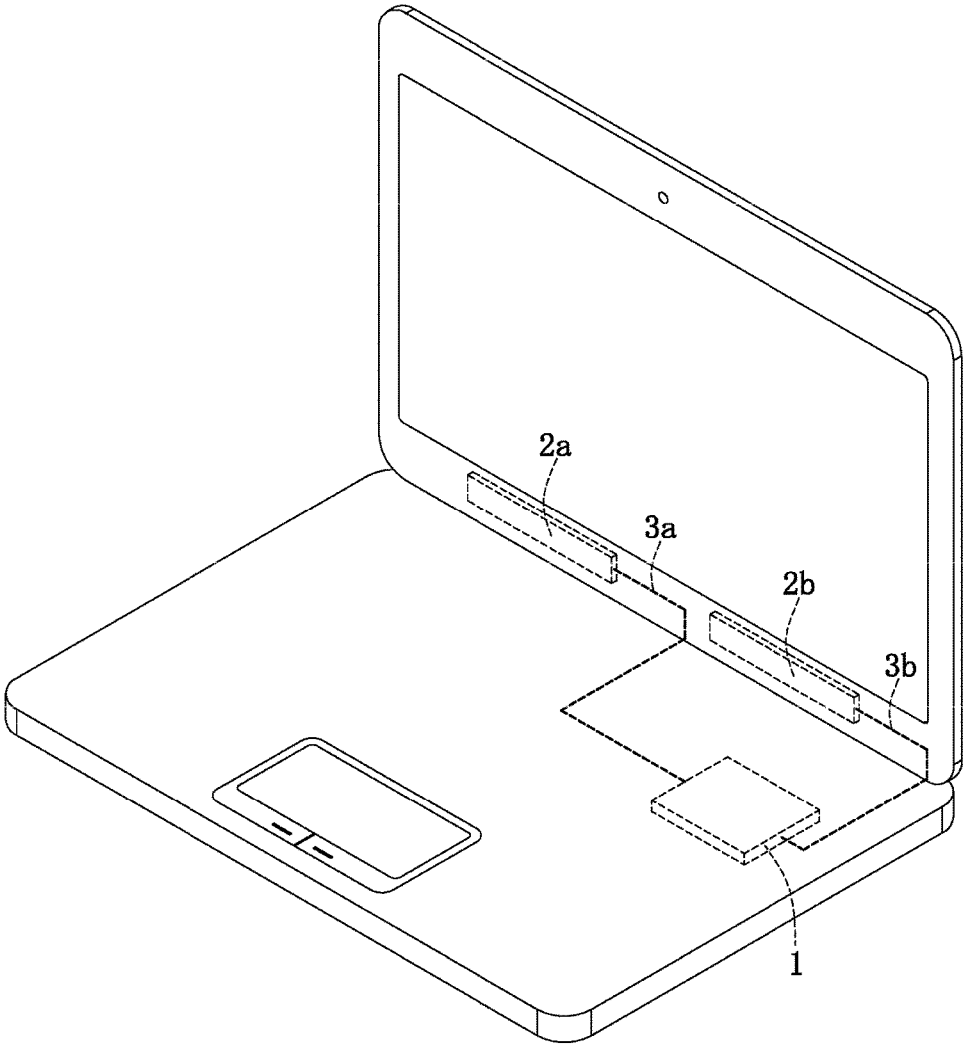
FIG .2 (PRIOR ART)
FIG. 2 is a schematic of a conventional embedded antenna for laptop.
Figure 3:
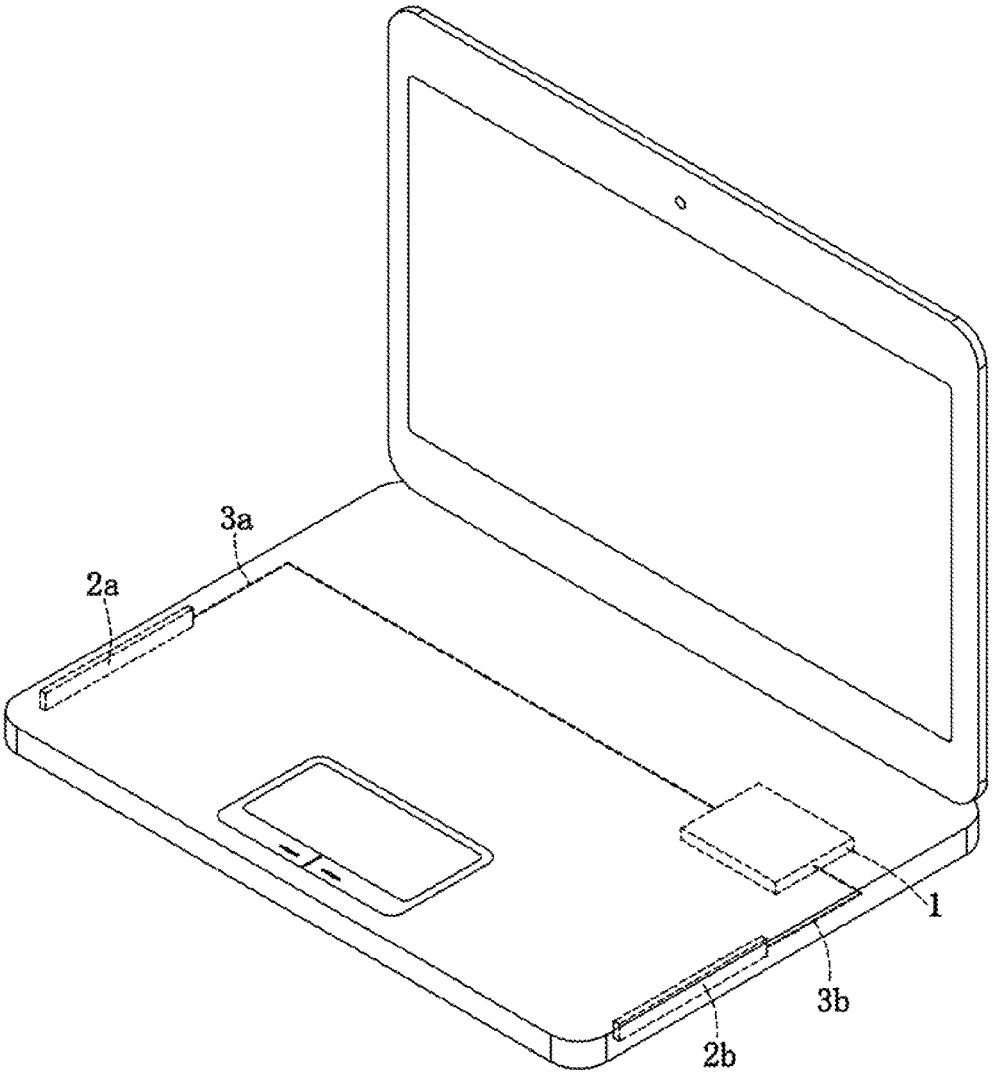
FIG .3 (PRIOR ART)
FIG. 3 is a schematic of a conventional embedded antenna for laptop.
Figure 4:
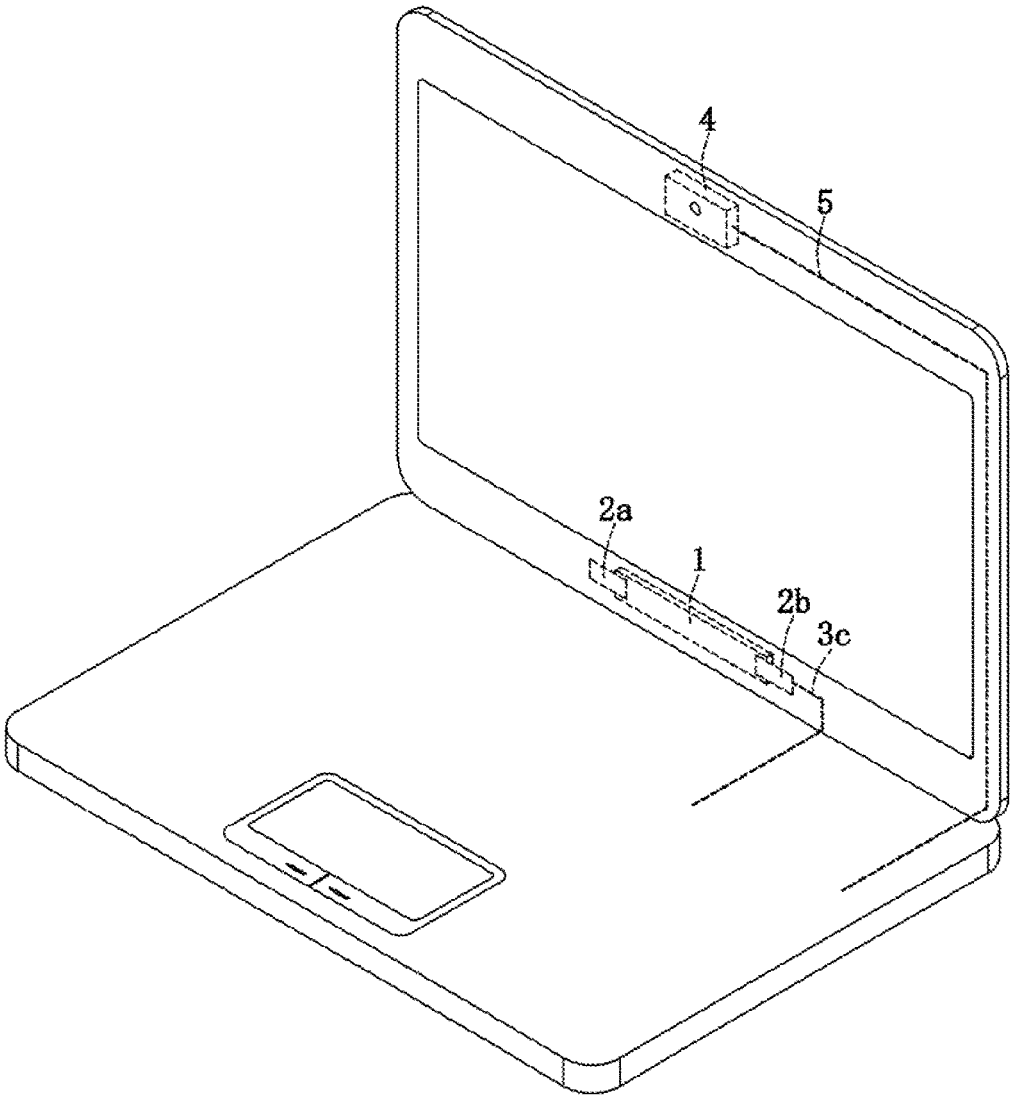
FIG .4 (PRIOR ART)
FIG. 4 is a schematic of a conventional embedded antenna and a camera module for laptop.
Figure 5A:
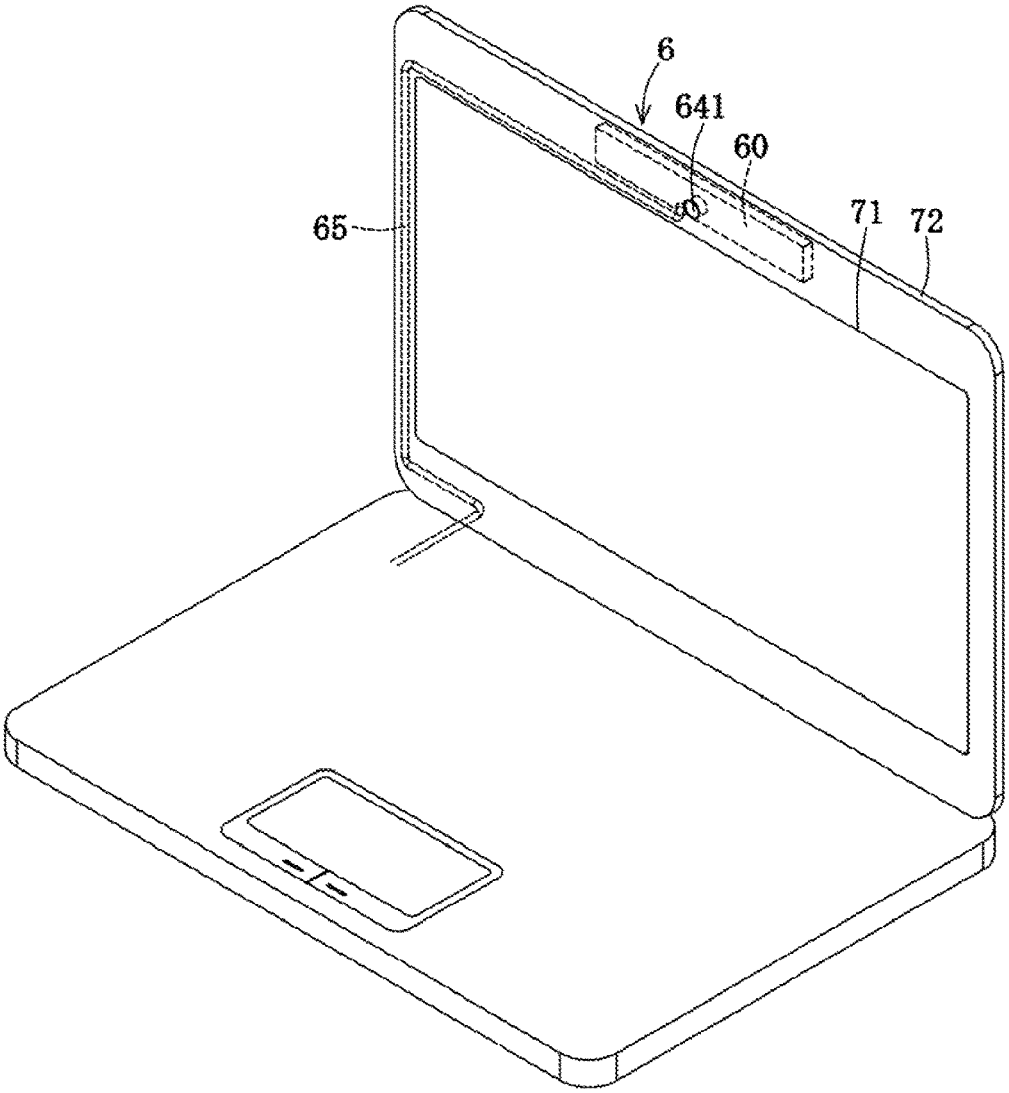
FIG. 5A is a schematic of a system of integrated module installed on the screen in one embodiment of the disclosure.
Figure 5B:
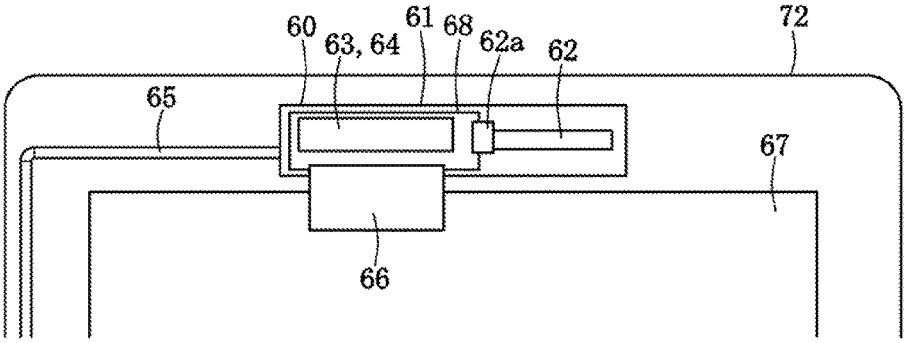
FIG. 5B is a schematic of a system of integrated module in one embodiment of the disclosure.

Please refer to FIG. 5A and FIG. 5B, wherein FIG. 5A is a schematic of a system of integrated module installed on the screen in one embodiment of the disclosure, and FIG. 5B is a schematic of a system of integrated module in one embodiment of the disclosure. As shown in FIG. 5A, the system of integrated module 6 in the embodiment is disposed adjacent to the upper edge of the laptop. However, the disclosure does not intend to limit the position of the system of integrated module 6, and that design may be applied for an electronic device such as a television, an integrated computer, etc. That is, the system of integrated module in FIG. 5A may also be applied for an electronic device such as a television, an integrated computer, etc. Hereinafter, the design for laptop is taken for example. In FIG. 5B, the screen 71 is omitted so that the arrangement of the system of integrated module 6 is illustrated. The components in the system of integrated module 6 other than the digital signal line 65 are illustrated in schematic in FIG. 5B. The system of integrated module 6 includes the circuit board 61, at least one antenna exciting unit 62, a wireless module 63, a system grounding plane 67, a grounding metal 66, a camera module 64, a digital signal line 65, and a module grounding plane 68. The wireless module 63 and the camera module 64 are electrically connected to the module grounding plane on the circuit board 61. One integrated module 60 is composed of the wireless module 63, the camera module 64 and the circuit board 61 and those components share the module grounding plane 68. Please refer to FIG. 5A. The integrated module 60 is disposed adjacent to the upper edge of the screen 71 of the laptop (electronic device), and, for example, in center of the upper edge of the screen 71. In practice, the integrated module 60 might not be disposed in the center of the upper edge of the screen 71, but disposed around the upper edge of the screen 71 of the laptop (electronic device). In addition, as shown in FIG. 5B, the at least one antenna exciting unit 62 is used for coupling with the antenna. Only one antenna exciting unit 62 is shown in FIG. 5B, but FIG. 5B is not to limit the disclosure but for illustration only. When more than one antenna is needed to be coupled, two or more antenna exciting units 62 may be used.

Then, please refer to FIG. 5B for illustrating the connections between the components of the system of integrated module 6. The wireless module 63 is disposed on the circuit board 61 and electrically connected to the antenna exciting unit 62 via the antenna signal feed-in terminal 62*a*. The antenna exciting unit 62 is for example the copper line on the circuit board 61, but it's not a limitation in the disclosure. The grounding metal 66 is electrically connected to the module grounding plane 68 and the system grounding plane 67. The camera module 64 is disposed on the circuit board 61. As shown in FIG. 5A, the camera module 64 includes a camera 641, and the camera 641 may be disposed adjacent to the center of the upper edge of the screen 71 of the laptop (electronic device). However, the disclosure does not intend to limit the arrangement thereof. In FIG. 5B and the following drawings, the camera 641 of the camera module 64 is omitted. Further, the digital signal line 65 is electrically connected to the wireless module 63 and the camera module 64, and acts as the digital communication interface between the wireless module 63 and the camera module 64. It should be noted that the wireless module 63 and the camera module 64 on the circuit board 61 in FIG. 5B are for illustration, and their detail circuit components are not shown. Further, FIG. 5B is a schematic only, and the disclosure does not intend to limit any of the size of the circuit board 61, the shape of the circuit board 61, the arrangement of the wireless module 63 on the circuit board 61, and the camera module 64 on the circuit board 61. Similarly, the disclosure does not intend to limit either the way the digital signal line 65 connected to the wireless module 63 and the camera module 64, or the position and routing of the digital signal line 65. The digital signal line 65 is merely for connecting the wireless module 63 and the camera module 64 to the system circuit (not shown) of the laptop (electronic device).

Figure 5C:
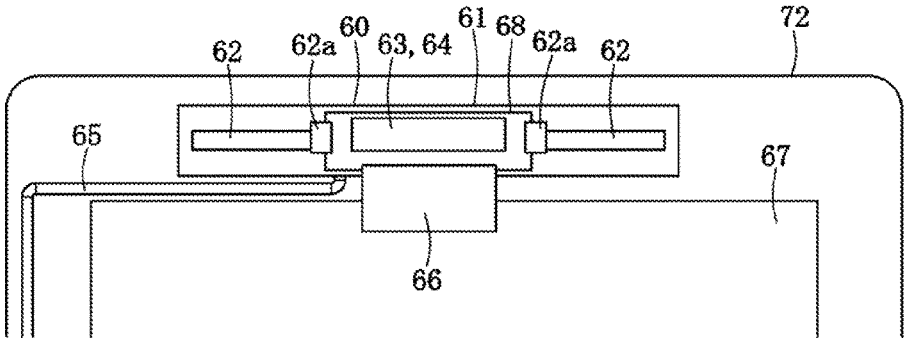
FIG. 5C is a schematic of a system of integrated module in another embodiment of the disclosure.

The system of integrated module 6 in the embodiment does not include the radiation element of antenna, which is also called as radiator of antenna. The system of integrated module 6 in the embodiment and the radiation element of antenna are individually arranged so the flexibility of design is improved. Further, as to the integration of the wireless module and the camera module, the radiator of antenna needs not to be taken into consideration, so the integration of the wireless module and the camera module may be achieved more easily. In FIG. 5B, the system of integrated module 6 has an antenna exciting unit 62. However, the system of integrated module 6 may have two or more antenna exciting units 62 according to the real application. For example, please refer to FIG. 5C, the system of integrated module 6 has two antenna exciting units 62 compared with FIG. 5B, and one of them is in the right side and the other is in the left side. However, the disclosure does not intend to limit the number of the antenna exciting units 62. Further, the number of the antennas coupled with the antenna exciting unit 62 is not limited. Especially, the laptop (electronic device) may need many antennas when it is applied in the multi-antenna system communication need. The wireless module 63 is used for coupling with the antenna via the antenna exciting unit 62 and coupling the radiofrequency signal of the wireless module to the radiator of antenna via the antenna exciting unit 62. The following description of the embodiment is an example in which the system of integrated module 6 has one antenna exciting unit 62 and the antenna exciting unit 62 is used for coupling with one antenna only.

Please refer to FIG. 5B again. The shape and position of the system grounding plane 67 in FIG. 5B is not for limiting the shape of the system grounding plane, but for illustrating how to connect with the grounding metal 66. In the aspect of grounding, when the back cover 72 behind the screen 71 of the laptop (electronic device) is made of metal totally or substantially, the system grounding plane 67 in FIG. 5B may be seen as the back cover 72 of the laptop (electronic device). Because the back cover 72 has larger area than the antenna, the back cover 72 of the laptop (electronic device) may be the system grounding plane 67 in the embodiment. The grounding metal 66 is, for example, a grounding metal plate, and the grounding metal 66 is used for making the system grounding plane 67 and the wireless module 63 and the camera module 64 be electrically connected to each other so that the antenna coupled with the antenna exciting unit 62 has large grounding plane. Accordingly, compared with the embedded antenna design in the conventional laptop (electronic device), the system of integrated module 6 in the embodiment provides larger system grounding plane for the coupled antenna so as to improve the efficiency of the antenna. Therefore, compared with the conventional design in FIG. 1 through FIG. 4, the system of integrated module 6 in the embodiment is capable of being connected directly to the system grounding plane such as the back cover behind the screen, and providing large grounding area for the wireless module 63, the antenna exciting unit 62, and the coupled antenna to improve the efficiency of radiation.

Additionally, the shape and type of the antenna exciting unit 62 in FIG. 5B is for example only. The disclosure does not intend to limit the implementation of the antenna exciting unit 62. For example, the antenna exciting unit 62 may be the copper wire printed on the circuit board 61. In another example, the antenna exciting unit 62 may be a metal component bonded or fixed on the circuit board 61. Whatever the implementation way is, the antenna exciting unit 62 may be directly connected to the antenna signal feed-in terminal 62*a* of the wireless module 63 so as to couple the radiofrequency signal. Simply speaking, one terminal of the antenna exciting unit 62 is electrically connected to the wireless module 63, and the other terminal of the antenna exciting unit 62 is coupled with the antenna. The way the antenna exciting unit 62 coupling with the antenna may be direct connection or non-contact energy coupling. The detail of the implementation of the system of integrated module in the embodiment will be illustrated with a variety of types of antenna in the following paragraphs so as to clarify the main spirit of the disclosure. It should be noted that the following FIG. 6 through FIG. 9 illustrate the way of coupling of the antenna and the application thereof, so the digital signal line 65 is omitted.

Figure 6:
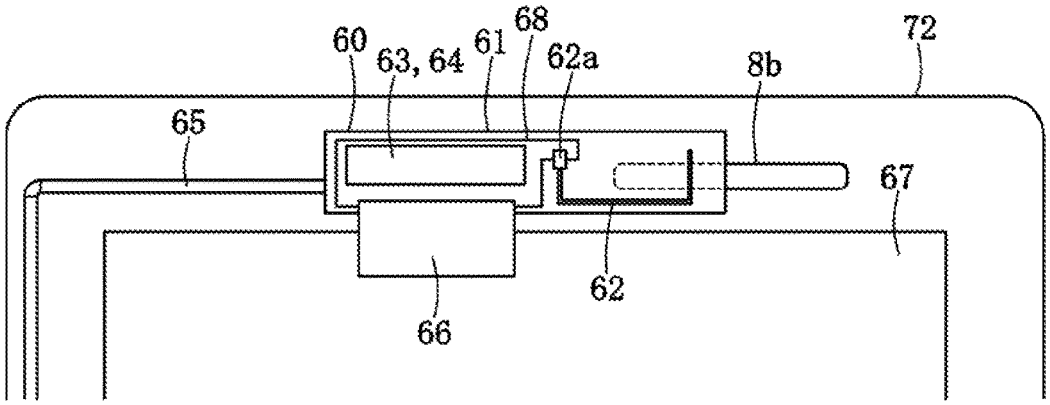
FIG. 6 is a schematic of a system of integrated module in another embodiment of the disclosure.

Please then refer to FIG. 6, which is a schematic of a system of integrated module in another embodiment of the disclosure. In FIG. 6, the antenna exciting unit 62 is a U-shaped printed copper wire. As to grounding, the module grounding plane 68 on the circuit board 61 is the grounding part of the wireless module 63 and the camera module 64. The module grounding plane 68 is directly connected to the grounding metal 66 and electrically connected to the system grounding plane 67 via the grounding metal 66. The back cover 72 in the embodiment is a metal back cover, and the system grounding plane 67 and the back cover 72 behind the screen 71 of the laptop (electronic device) are connected to the same grounding terminal, so the system grounding plane 67 in the embodiment is the back cover 72 behind the screen 71 of the laptop (electronic device). On the other hand, as to antenna, the antenna in the embodiment is a slot antenna, and its radiator of slot antenna 8*b* is implemented by caving on the metal back cover 72. The radiator of slot antenna 8*b* is energy coupled with the antenna exciting unit 62 without contact. The radiator of slot antenna 8*b* in the embodiment is also electrically connected to the system grounding plane 67, but the radiator of slot antenna 8*b* is on the metal casing of the back cover 72. Further, the disclosure does not intend to limit the size or the shape of the slot. The size and the shape of the slot may be adjusted according to the requirement of performance such as operating frequency of the antenna, the impedance matching of the antenna, etc.

Figure 7:
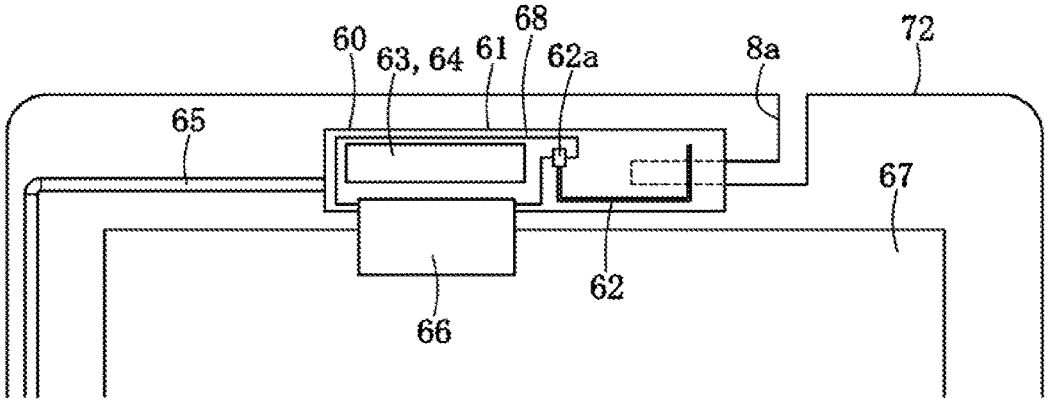
FIG. 7 is a schematic of a system of integrated module in another embodiment of the disclosure.

Please then refer to FIG. 7, which is a schematic of a system of integrated module in another embodiment of the disclosure. Compared with FIG. 6, the antenna in the embodiment is an open-slot antenna. The radiator of open-slot antenna 8*a* is also on the metal back cover 72 and is inverted-L shape. However, the disclosure does not intend to limit the shape or the size of the radiator of open-slot antenna 8*a*. It's only needed that the radiator of open-slot antenna 8*a* is adjacent to and capable of coupling with the antenna exciting unit 62. In real application, the radiator of open-slot antenna 8*a* may be directly connected to the antenna exciting unit 62, or the radiator of open-slot antenna 8*a* and the antenna exciting unit 62 are energy coupling with each other without contact with each other.

Figure 8:
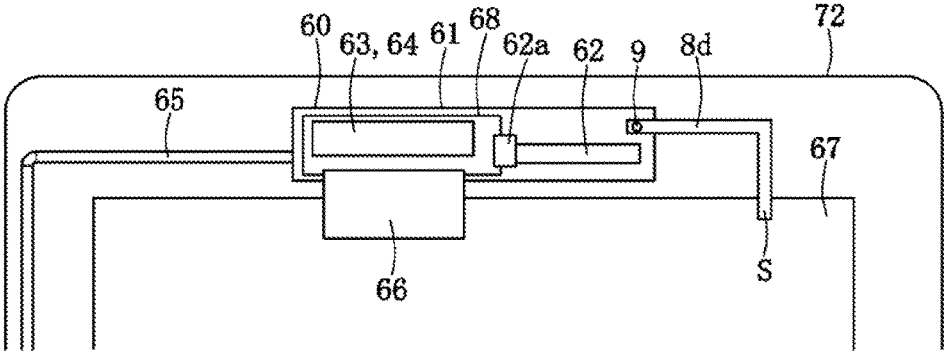
FIG. 8 is a schematic of a system of integrated module in another embodiment of the disclosure.

Please then refer to FIG. 8, which is a schematic of a system of integrated module in another embodiment of the disclosure. The antenna in the embodiment is a coupling loop antenna comprising the radiator of coupling loop antenna 8*d*. One terminal of the radiator of coupling loop antenna 8*d* is coupled with the antenna exciting unit 62, and the other terminal of the radiator of coupling loop antenna 8*d* is electrically connected to the system grounding plane 67. Here, in the aspect of grounding, in FIG. 8, the system grounding plane 67 and the back cover 72 are connected to each other to form one component. The back cover 72 is, for example, a metal back cover or a back cover of which at least part is metal. In FIG. 8, the radiator of coupling antenna 8*d* is an L-shaped metal bracket. However, the disclosure does not intend to limit the shape of the radiator of coupling antenna 8*d*. One terminal of the radiator of coupling loop antenna 8*d* is coupled with the antenna exciting unit 62 and the other terminal thereof is the short terminal S in FIG. 8 coupled to ground so as to construct a loop antenna. The way of One terminal of the radiator of coupling loop antenna 8*d* coupling with the antenna exciting unit 62 is implemented by at least one conductive screw column 9, and the conductive screw column 9 is capable of fixing one terminal of the radiator of coupling loop antenna 8*d* to the circuit board 61 so that the terminal of the radiator of coupling loop antenna 8*d* is adjacent to and capable of coupling with the antenna exciting unit 62.

Figure 9:
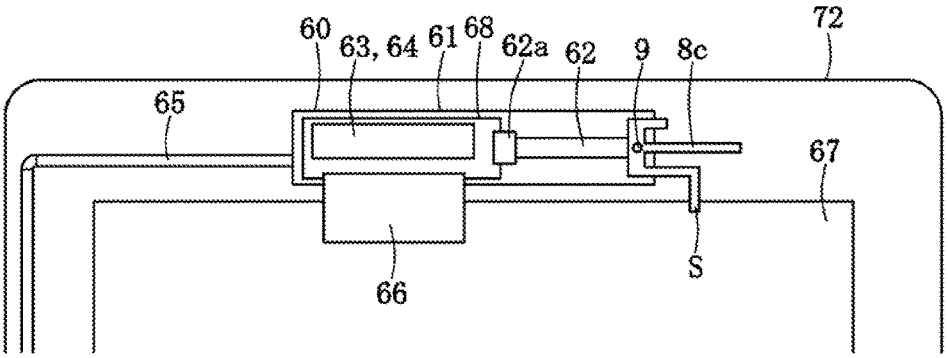
FIG. 9 is a schematic of a system of integrated module in another embodiment of the disclosure.

FIG. 9 is a schematic of a system of integrated module in another embodiment of the disclosure. The antenna exciting unit 62 is connected to the radiator of inverted-F antenna 8*c* via at least one conductive screw column 9 so as to construct an inverted-F antenna with one terminal connected to the system grounding plane 67 and the other terminal left open. The radiator of inverted-F antenna 8*c* may be implemented with a metal bracket. The short terminal S in FIG. 9 is the terminal of the radiator of inverted-F antenna 8*c* and connected to the system grounding plane 67. In the aspect of grounding, the system grounding plane 67 and the back cover 72 are connected to each other to form one component. The back cover 72 is, for example, the metal back cover or the back cover of which at least part is metal.

The antennas described in FIG. 6 through FIG. 9 are not to limit the system of integrated module to the embodiment of the disclosure. The system of integrated module in the embodiment of the disclosure may couple with other types of antenna. Simply, the system of integrated module in the embodiment of the disclosure has the feed-in part of the antenna exciting unit for the radiofrequency signal, and it's not necessarily to be assembly together with the antenna, so the flexibility of design and applicability are increased. In other words, the aforementioned types of antenna are not to limit the system of integrated module in the embodiments of the disclosure but for example only.

As above, the system of integrated module in the embodiments of the disclosure may realize the embedded antenna integrated with the camera module without the obstacle of wounding of the co-axial cable and the problem of attenuation of the radiofrequency of the co-axial cable, and capable of providing good performance of antenna.

The aforementioned is not to limit the scope of the disclosure but the embodiment.

What is claimed is:

1. A system of integrated module for being installed in an electronic device, wherein the system of integrated module comprising:

a circuit board;

at least one antenna exciting unit for coupling with an antenna;

a module grounding plane disposed on the circuit board;

a wireless module disposed on the circuit board, electrically connected to the module grounding plane and the antenna exciting unit, used for transceiving a radiofrequency signal via the antenna exciting unit;

a grounding metal electrically connected to the module grounding plane and a system grounding plane;

a camera module disposed on the circuit board and electrically connected to the module grounding plane; and a digital signal line electrically connected to the wireless module and the camera module, and acting as a digital communication interface between the wireless module and the camera module;

wherein an integrated module is composed of the wireless module, the camera module and the circuit board, and the integrated module is disposed adjacent to an upper edge of a screen of the electronic device.

2. The system of integrated module according to claim 1, wherein the system grounding plane is a back cover of the electronic device.

3. The system of integrated module according to claim 1, wherein the antenna which the antenna exciting unit is coupled to is an open-slot antenna on the system grounding plane.

4. The system of integrated module according to claim 1, wherein the antenna which the antenna exciting unit is coupled to is a close-slot antenna on the system grounding plane.

5. The system of integrated module according to claim 1, wherein the antenna is a coupling loop antenna, a first terminal of the antenna is coupled to the antenna exciting unit, and a second terminal of the antenna is electrically connected to the system grounding plane.

6. The system of integrated module according to claim 1, wherein the antenna exciting unit is connected to the antenna via at least one conductive screw column and the antenna is an inverted-F antenna with one terminal connected to the system grounding plane and the other terminal opened.

7. The system of integrated module according to claim 1, wherein the camera module comprises a camera disposed adjacent to center of the upper edge of the screen of the electronic device.

* * * * *